US008439052B2

(12) United States Patent
Klein

(10) Patent No.: US 8,439,052 B2
(45) Date of Patent: May 14, 2013

(54) LIQUID-CONDUCTING ELECTRICAL HOUSEHOLD APPLIANCE

(75) Inventor: Hans-Wilhelm Klein, Würzburg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1562 days.

(21) Appl. No.: 10/587,192

(22) PCT Filed: Jan. 20, 2005

(86) PCT No.: PCT/EP2005/050239

§ 371 (c)(1),
(2), (4) Date: Jul. 24, 2006

(87) PCT Pub. No.: WO2005/070275

PCT Pub. Date: Aug. 4, 2005

(65) Prior Publication Data

US 2007/0163626 A1 Jul. 19, 2007

(30) Foreign Application Priority Data

Jan. 23, 2004 (DE) ..... 10 2004 003 536

(51) Int. Cl.
*A47L 15/42* (2006.01)

(52) U.S. Cl.
USPC ..... 134/109

(58) Field of Classification Search ..... 134/109
See application file for complete search history.

(56) References Cited

U.S. PATENT DOCUMENTS

| | | | | |
|---|---|---|---|---|
| 3,542,496 | A * | 11/1970 | Thomas et al. | 417/423.1 |
| 5,859,520 | A * | 1/1999 | Bourgeois et al. | 318/805 |
| 6,481,973 | B1 * | 11/2002 | Struthers | 417/36 |
| 6,775,468 | B2 | 8/2004 | Zinke et al. | |
| 2005/0005952 | A1 * | 1/2005 | Bashark | 134/18 |
| 2006/0130876 | A1 | 6/2006 | Curtius et al. | |

FOREIGN PATENT DOCUMENTS

| | | | | |
|---|---|---|---|---|
| DE | 2946049 | A | * | 5/1981 |
| DE | 36 26 351 | A1 | | 2/1988 |
| DE | 38 03 006 | A1 | | 8/1989 |
| DE | 3803006 | | * | 8/1989 |
| DE | 4418721 | A1 | | 11/1995 |
| DE | 19630357 | A1 | | 2/1998 |
| DE | 19840291 | A1 | | 3/2000 |
| DE | 101 39 928 | A1 | | 4/2003 |
| DE | 10154630 | A1 | | 5/2003 |
| DE | 102 55 380 | A1 | | 6/2004 |
| EP | 0 255 863 | A2 | | 2/1988 |
| EP | 0838192 | A1 | | 4/1998 |
| JP | 5-317231 | | | 3/1993 |
| JP | 6-14862 | | | 1/1994 |
| JP | 938014 | | * | 8/1995 |
| JP | 410252680 | A | * | 9/1998 |

(Continued)

*Primary Examiner* — Michael Barr

*Assistant Examiner* — Jason Riggleman

(74) *Attorney, Agent, or Firm* — James E. Howard; Andre Pallapies

(57) ABSTRACT

An electric household appliance has a chamber that is at least partially filled with liquid during operation of the appliance. A motor drives a pump for drawing liquid from the chamber. A monitoring device detects the rotational speed and the power of the motor, compares detected values for the rotational speed and power to a predefined characteristic, and signals an exceptional state if the comparison indicates that the detected values deviate significantly from the characteristic.

16 Claims, 2 Drawing Sheets

FOREIGN PATENT DOCUMENTS

| | | | |
|---|---|---|---|
| JP | 2002-051964 | * | 8/2000 |
| JP | 2001-339980 | * | 12/2001 |
| JP | 2001-339980 | A | 12/2001 |
| JP | 2002-51964 | A | 2/2002 |

* cited by examiner

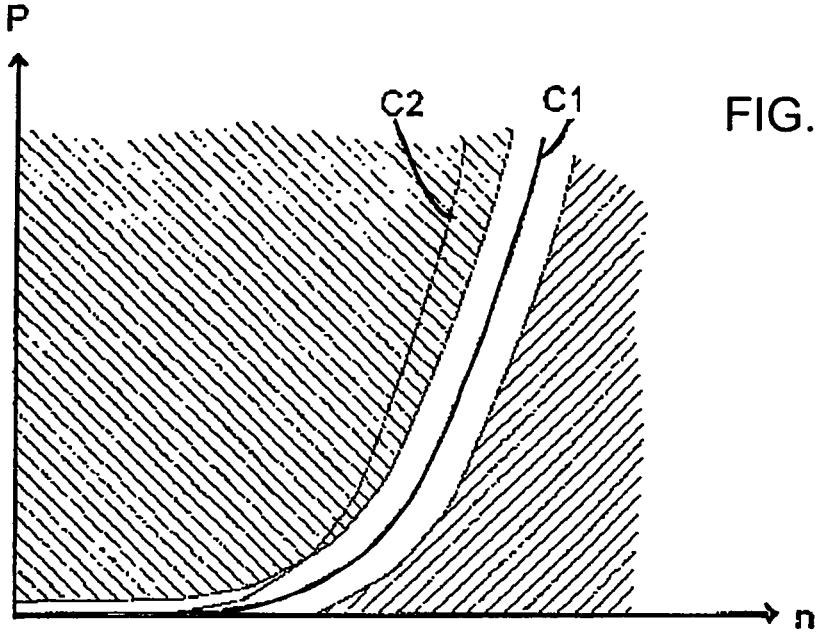
FIG. 3
FIG. 4
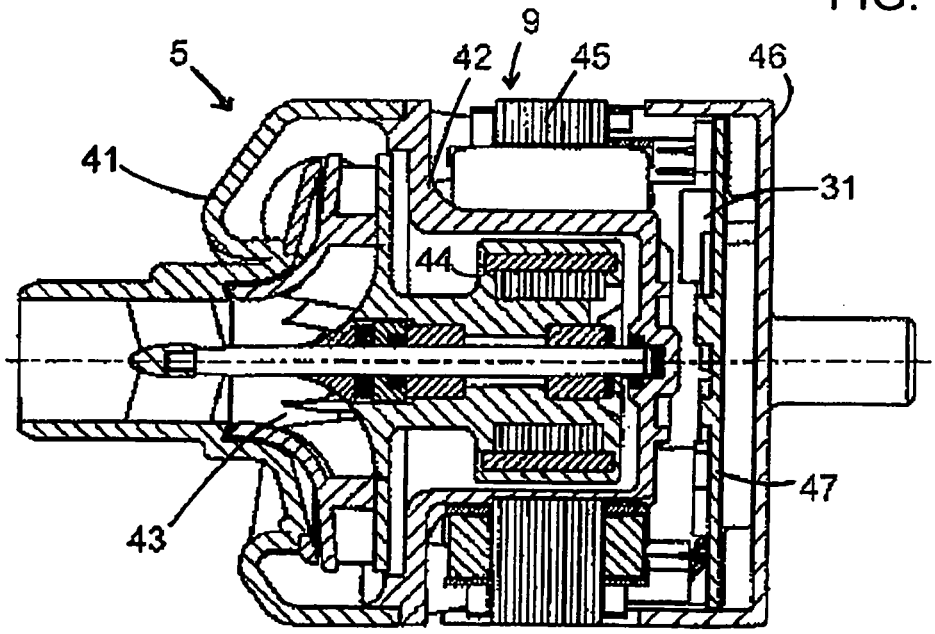

LIQUID-CONDUCTING ELECTRICAL HOUSEHOLD APPLIANCE

BACKGROUND OF THE INVENTION

Field of the Invention

The present invention relates to an electrical household appliance comprising a chamber which is at least partially filled with liquid during operation of the appliance and a pump driven by a motor for sucking out liquid from the chamber. Such a household appliance can in particular be a dishwasher or a washing machine and the pump is a discharge pump which sucks out cleaning liquor from a lower part of the chamber in order to spray it on to items to be cleaned which are located in the chamber or to pump it away from the chamber.

If the quantity of washing liquor in the chamber is too low, unsatisfactory cleaning results are achieved because the pump sucks in air in addition to the cleaning liquor and an adequate liquor pressure for satisfactory cleaning results is not achieved at the pressure output of the pump. If, on the other hand, the quantity of liquor in the chamber is larger than is necessary, this results in uneconomic operation on the one hand because of the unnecessarily high water costs and on the other hand because the energy requirement for heating the liquor to the desired cleaning temperature increases together with the quantity of liquor. It is therefore important to match the quantity of liquor exactly to the requirement. This can be achieved, for example, by installing a flow meter in an inlet pipe of the chamber which monitors the amount of fresh water taken in and shuts off a valve in the inlet pipe when a predetermined amount of water is reached. Such a flow meter is not only costly but it is also unable to match the amount of water taken-in in individual cases to the degree of contamination of the items to be cleaned with the machine. If a dishwasher, for example is loaded with severely contaminated dishes, proteins contained in the contamination can result in substantial foaming of the rinsing liquor with the result that not only rinsing liquor but also foam is sucked out by the pump. In exactly the same way as sucked-in air when the liquor level is too low, the foam prevents the build-up of a sufficiently high pressure at the pump output and thus a satisfactory cleaning effect. The foaming can be counteracted by letting in a larger quantity of water but this is uneconomical if it happens during every cleaning process, as described above. Conventional dishwashers therefore frequently have program buttons which allow a user to select different washing programs with different water usage according to the degree of contamination of the loaded dishes. Since the assessment of the degree of contamination by the user is to a certain extent subjective, and it is easy to forget to use the appropriate selection button, optimal efficiency cannot be ensured in this way.

With a machine which is able to individually adapt the amount of water used in each case to the degree of contamination of the items to be cleaned, it would not only be possible to increase user friendliness but also to improve the economic efficiency.

If the cleaning liquor is severely contaminated, this can result in a blockage of the pump or its upstream or downstream pipes which blocks the movement of the pump and therefore the motor. Since in such a case, the motor performs no mechanical work, the entire electrical power taken up thereby, which is possibly increased under such circumstances compared with normal operation, is converted into heat which can result in damage or even destruction of the motor. In principle, it is possible to detect such a blockage using a flow meter of the aforesaid type connected in series with the pump but as stated above, such a sensor is costly and it takes up valuable space in the household appliance.

SUMMARY OF THE INVENTION

It is the object of the invention to provide an electrical household appliance of the type defined initially which allows the recognition of disturbances in the fluid flow through the pump using simple, inexpensive and reliable means.

The invention assumes that a fixed relationship exists between the rotational speed and power of the motor, which is substantially determined by the design of the pump and the flow resistances of pipes through which the pump pumps the liquid. Upward or downward deviations from this relationship which can be determined empirically for a given model of household appliance respectively indicate different types of disturbances. For this reason the household appliance has a monitoring device for detecting the rotational speed and power of the motor, for comparing detected values of rotational speed and power with a predefined characteristic and for signalling an exceptional state if the comparison indicates that the detected values deviate significantly from the characteristic.

If the detected power of the motor for a detected rotational speed is significantly lower than a power to be expected for the detected rotational speed using the predefined characteristic, this is an indication that not only liquid but also foam or air are being pumped. Both problems can be remedied by letting additional water into the chamber of the household appliance. For this reason, the household appliance has an inlet valve for admitting liquid into the chamber and a control device which is set up to open the inlet valve when the monitoring device signals a first exceptional state in which the detected power for the detected rotational speed is significantly lower than a power which is to expected for this rotational speed with reference to the characteristic.

Equivalent to a detected power which is lower than that to be expected for the detected rotational speed using this characteristic is the detection of a rotational speed which is significantly higher than that to be expected using this characteristic for a given power.

The household appliance can have a plurality of circulating paths via which the liquid circulated by the pump can be guided as desired, as described in Wegner, Electrical Household Appliances/Engineering and Service, Verlag Hüthig & Pflaum 2000, for a washing machine. Since different circulating paths of this type have different flow resistances, the monitoring device is appropriately set up to use a specific characteristic for the respectively selected circulating path as the basis for comparison depending on the selected circulating path.

It can also be appropriate to use different characteristics as the basis for comparison in the course of the working sequence of the household appliance. Thus, for example, in an initial phase of the working sequence of a dishwasher, a first characteristic can be taken as the basis assuming that at this time a deviation from the characteristic indicates that the pump is sucking in air as a result of an inadequate amount of liquor. In a later phase of the sequence, in particular if the amount of liquor has already been adjusted using the aforementioned first characteristic, a deviating characteristic of power and rotational speed can be used to detect foam formation.

If the monitoring device signals a second exceptional state in which the power detected together with a detected rotational speed is significantly higher than is to be expected using the predefined characteristic, this can indicate a fault in the movement of the motor. In this case, it can be provided that the control device interrupts the working sequence of the household appliance to protect the motor or that it delivers a warning signal to request a user to take countermeasures to protect the motor.

It is known per se to connect a filter for collecting impurities in the pump liquid before the inlet to the pump. An elevated power of the motor in relation to the rotational speed can also indicate a blockage of this filter so that an appropriate reaction of the control device to an elevated power detected by the monitoring device can be to control or instigate cleaning, in particular a flushing of this filter.

A synchronous motor is preferably used as the motor in the household appliance according to the invention. Such a motor allows its rotational speed to be detected comparatively simply merely by monitoring the time behaviour of the electromotive force in the windings of the motor, i.e. the currents or voltages occurring at the motor so that expensive and space-consuming sensors are not required on the motor or the pump to determine the rotational speed.

The armature of the motor is preferably located in a pump chamber of the pump. Such an armature, also known as a wet armature can dispense with a seal on the shaft between the armature and the pump where friction losses could occur to a degree which cannot be accurately monitored. This design of armature thus allows the mechanical power delivered by the pump to be determined particularly accurately from the electrical power taken up by the motor.

Further features and advantages of the invention are obtained from the following description of exemplary embodiments with reference to the appended figures.

In the figures:

BRIEF DESCRIPTION OF THE DRAWINGS

FIG. 3 shows example of the rotational speed-power characteristics forming the basis of the motor controller; and FIG. 4 shows a section through an assembly which combines the pump, the motor and the supply electronics.

DESCRIPTION OF THE PREFERRED EMBODIMENTS

Figure 1:
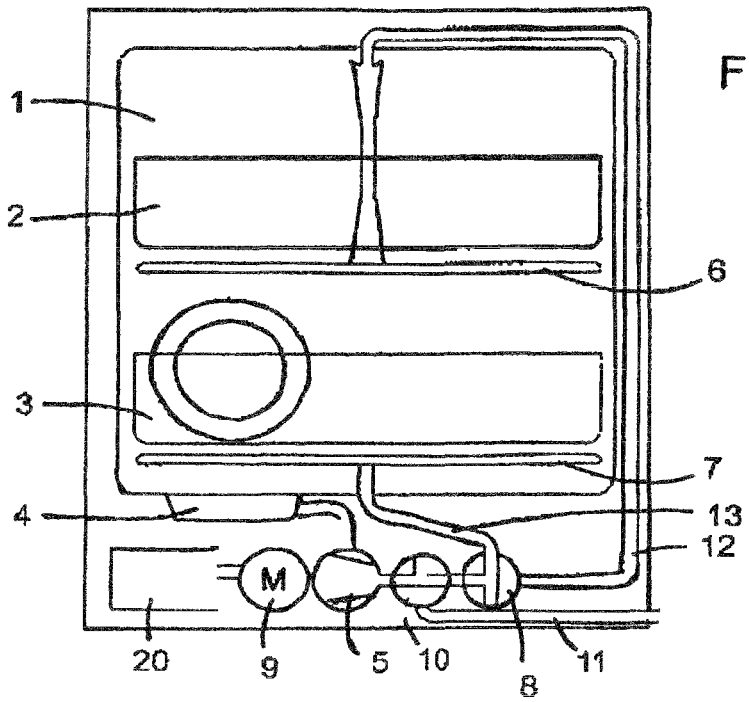
FIG. 1 shows a schematic section through a dishwasher according to the invention.
Figure 2:
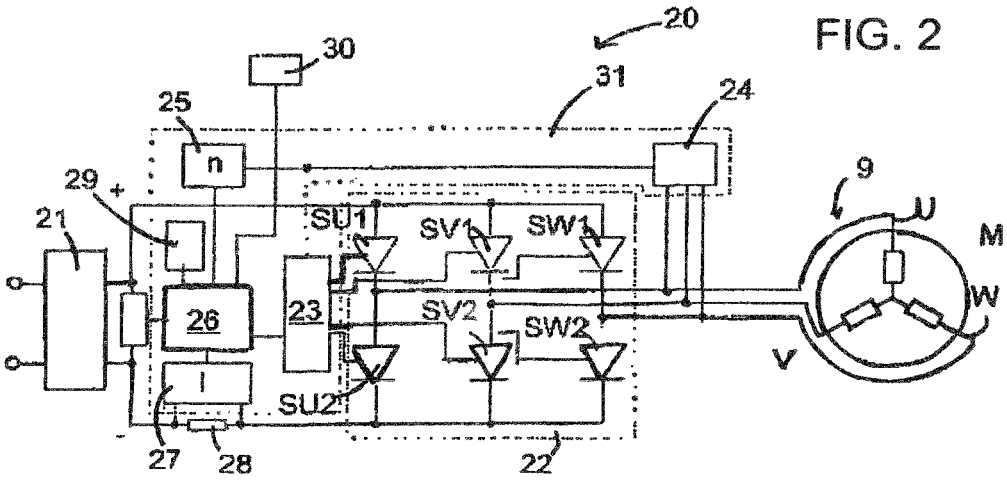
FIG. 2 is a block diagram of the motor of the circulating pump of the dishwasher from FIG. 1 as well as its supply electronics.

FIG. 1 shows a schematic section through a dishwasher comprising a washing chamber 1 in which baskets 2 and 3 are located in a usual manner such that they can be pulled out guided on rails. Located in a recess at the bottom of the washing chamber 1 is a washing water filter 4 through which a pump 5, which is explained in further detail subsequently with reference to FIG. 2, sucks washing water to supply rotatably mounted nozzle arms 6, 7 which are mounted respectively underneath the baskets 2, 3 to spray the items to be washed contained therein. A directional valve 8 located between the output of the pump 5 and the nozzle arm 6 or 7 is periodically switched by a microcontroller 31 (see FIG. 2) between the position shown in the figure in which lower nozzle arm 7 is supplied with washing water via a pipe 13 and a position in which the upper nozzle arm 6 is supplied via a pipe 12.

Naturally, in a simpler configuration the valve 8 could also be omitted so that both nozzle arms 6, 7 are supplied at the same time. In this case, however, both pipes 12, 13 must be filled with water at the same time during operation of the nozzle arms 6, 7 so that the overall amount of water required for washing is greater than that during alternating operation of the spray arms 6, 7 using the valve 8.

An inlet valve 10 also controlled by the microcontroller 31 is used for the controlled admission of fresh water into the washing chamber via a fresh water pipe 11.

The pump 5 is driven by a brushless DC motor 9 which is supplied with energy by a supply electronics block 20. The motor 9 and the supply electronics block 20 are shown in greater detail in a block diagram in FIG. 2. The motor 9 has three stator windings, designated as U, V, W which are connected in a star configuration here. The supply electronics block 20 comprises a mains rectifier 21 which delivers an intermediate DC voltage. This intermediate DC voltage supplies three phases of an AC/DC inverter 22, each comprising two switches connected in series SU1, SU2 or SV1, SV2 or SW1, SW2, each in the form of a power transistor with parallel suppressor diode. The point between two switches of each phase is connected to the allocated winding U, V or W of the motor. The state, open or closed, of each switch is controlled by a switch pattern generator 23 which receives a representative signal for the instantaneous phase ö of the motor shaft from a phase detector 24 and using this phase signal determines the current supplied to the stator windings U, V, W of the motor 9 so that the magnetic field generated by the stator windings U, V, W in the motor 9 has a certain advance in front of the phase of its armature and drives this.

The phase detector 24 can be formed by one or more magnetic field sensors such as Hall sensors which are exposed to the magnetic field of the armature or of rotating magnets coupled to the armature. This is preferably a purely electronic phase detector as described in U.S. Pat. No. 5,859,520, for example, which evaluates a zero crossing point of the electromotive force induced by the magnetic field of the armature in a temporarily current-free winding U, V or W of the motor in order to deduce the phase ö of the armature therefrom.

The phase signal delivered by the phase detector 24 is also received by a rotational speed measuring circuit 25 which determines the rotational speed n of the motor 9 by forming a time derivative, measuring the period or similar.

The rotational speed measuring circuit 25 delivers a representative signal for the detected rotational speed n to a monitoring circuit 26.

A current measuring circuit 27 has two inputs which are connected to the two terminals of a measurement resistor 28 which is connected in series with the AC/DC inverter 22 between the output terminals of the mains rectifier 21. The current flowing through the measurement resistor 28 is thus the sum of the currents flowing through the three phases of the AC/DC inverter 22 and is therefore proportional to the electrical power taken up by the motor 9 provided that the intermediate circuit voltage at the output of the rectifier 21 is constant. Accordingly, the voltage difference between the two input terminals of the current measuring circuit 27 is also proportional to the input electric power. The current measuring circuit 27 delivers a digital signal representative for this power to the monitoring circuit 26.

A read-only memory 29 connected to the monitoring circuit 26 stores a plurality of rotational speed-power characteristics which each describe a relationship between the rotational speed n and the input electric power P, each corresponding to a normal operation. These characteristics which particularly depend on the shape and flow cross section of the paths via which the washing water is pumped have been determined in advance on a prototype of the dishwasher. FIG.

3 shows two such characteristics, designated as C1 and C2, where C2 corresponds to a higher flow resistance than C1 such as that which occurs during operation of the upper spray arm 6 because the pump head to be overcome is greater than in the case of the lower spray arm 7. The monitoring device 26 in each case selects a characteristic allocated to the current position of the directional valve 8, e.g. in the position of the directional valve 8 shown in FIG. 1, the characteristic C1, reads from the read-only memory 29 the theoretical power value corresponding to an actual rotational speed delivered by the rotational speed measuring circuit 25 according to this characteristic C1 and compares this with an actual power calculated using a current intensity delivered simultaneously by the current measuring circuit 27. If the actual power differs from the theoretical power by more than a permissible amount, the monitoring circuit 26 generates a fault indication which is delivered to an automatic programming system 30 and which specifies the direction of the deviation.

If the measured power is significantly lower than the theoretical power, i.e. if the pair of values of the actual rotational speed and power lies in the ascendingly hatched area of the diagram in FIG. 3, this means that the pump 5 is not only sucking in water but also foam or air. If this state is detected on first switching on the pump 5 after admitting water at the beginning of a washing process, this can be attributed to the fact that the quantity of water in the washing chamber 1 is not sufficient. The automatic programming system 30 thereupon opens the inlet valve 10 to admit fresh water into the washing chamber 1 until the monitoring device 26 stops indicating the fault or until a predefined time interval has elapsed. If the fault indication has not yet disappeared after this time interval has elapsed, the automatic programming system 30 shuts the inlet valve 10 and interrupts the washing process in order to prevent the washing chamber 1 being overfilled with water as a result of a detection error. At the same time, the automatic programming system 30 activates a display light (not shown) on the housing of the dishwasher to indicate a fault to the user.

If a motor power which is too low in relation to the rotational speed is only detected at a later time in the washing program after adding the rinsing agent, the fault is not generally attributable to the water level being too low from the start but to strong foaming which results in foam being sucked into the pump. In order to reduce the foam, the automatic programming system 30 likewise opens the inlet valve 10 but only for a predetermined short time. The washing process can then be continued, the automatic programming system 30 then ignoring the fault indication for a predetermined time interval to give the foam the opportunity to dissolve during operation or operation of the machine is interrupted for a few minutes to allow the foam to dissolve.

If the fault signal of the monitoring circuit 26 indicates that the power of the motor 9 is too high for the measured rotational speed, in most cases a blockage of the filter 4 is the cause. In this case, the automatic programming system 30 interrupts the washing process and indicates an unscheduled interruption of the washing program by means of a signal light on the appliance housing. If the filter 4 is of the self-cleaning type, the pumping away of the washing water after interruption of the program can be sufficient to clean the filter 4 so that a user merely needs to re-start the machine. Otherwise, he must clean the filter 4 himself before re-starting the machine.

In principle it is possible to implement all the afore-mentioned components 23 to 30, possibly with the exception of the measurement resistor 28 in a common microcontroller. In the diagram in FIG. 2 a microcontroller 31 symbolised as a dashed frame comprises the components 23 to 27 and 29; the automatic programming system 30 which not only controls the pump 5 but also components remote therefrom such as the directional valve 8, heating devices (not shown), inlet and outlet valves and processes user commands, is spatially separate from the microcontroller 31.

A preferred configuration of an assembly comprising the microcontroller 31, the motor 9 and the pump 5 is shown in sectional view in FIG. 4.

The pump 5 is a vane pump comprising a housing consisting of a front housing shell 41 and a pot-shaped shield 42 which define a one-part pump chamber. The pump chamber contains an impeller 43 and an armature 44 of the brushless DC motor 9 engaging in the pot-shaped recess of the shield 42. The impeller 44 is immersed in the liquid pumped by the pump and cooled thereby. The stator 45 of the motor 9 is mounted on a housing shell 46 in which a plate 47 is anchored, which carries the microcontroller 31 and the measurement resistor 28. The assembly comprising housing shell 46 and stator 45 is outwardly inverted over the shield 42 in the manner of a cup.

I claim:

1. An electrical household appliance, comprising:

a chamber to be at least partially filled with liquid during operation of the appliance;

a pump driven by a motor and connected for drawing out liquid from said chamber; and a monitoring device configured to detect both an actual rotational speed and an actual power of said motor, to compare the detected actual values of the rotational speed and power with expected rotational speed and power values of a predefined characteristic, and to signal an exceptional state when a comparison result indicates that the detected actual values deviate from the predefined characteristic by more than a permissible amount.

2. The electrical household appliance according to claim 1, further comprising: a read only memory connected to said monitoring device, said read only memory storing a plurality of predefined rotational speed-power characteristics each describing a relationship between rotational speed and power, said monitoring device configured for respectively selecting one of the predefined rotational speed-power characteristics allocated to a current working sequence of the household appliance, said monitoring device configured for reading an expected power value from said read only memory corresponding to the actual speed according to the predefined characteristic selected, said monitoring device configured for comparing the expected power value with the actual detected power value and generating a fault indication if the actual detected power differs from the expected power by more than a permissible amount.

3. The electrical household appliance according to claim 2, further comprising a directional valve connected to said pump wherein said monitoring device is configured for respectively selecting one of the predefined rotational speed-power characteristics allocated to a current position of said directional valve.

4. The electrical household appliance according to claim 1, which further comprises an inlet valve communicating with and selectively admitting liquid into said chamber, a control device connected to said inlet valve for opening said inlet valve when said monitoring device signals a first exceptional state in which the power for a detected rotational speed is lower than a permissible amount to be expected for the detected rotational speed with reference to the predefined characteristic.

5. The electrical household appliance according to claim 1, which comprises a plurality of circulating paths for selectively guiding the liquid being circulated by the pump, and wherein said monitoring device is configured to use a specific characteristic for the respectively selected circulating path as a basis for the comparison depending on the selected circulating path.

6. The electrical household appliance according to claim 1 wherein said monitoring device is configured to use different characteristics as a basis for the comparison in a course of a working sequence of the household appliance.

7. The electrical household appliance according to claim 1, wherein said control device is configured to interrupt a working sequence of the household appliance if said monitoring device signals a second exceptional state in which the power detected at a detected rotational speed is higher than a permissible amount to be expected using the predefined characteristic for the detected rotational speed.

8. The electrical household appliance according to claim 1, wherein said control device is configured to generate a warning signal if said monitoring device signals a second exceptional state in which the actual power detected at the detected actual rotational speed is higher than a permissible amount to be expected using the predefined characteristic for the detected rotational speed.

9. The electrical household appliance according to claim 1, which comprises a filter disposed before an inlet to said pump, and wherein said control device is configured to initiate a flushing of said filter if said monitoring device signals a second exceptional state in which the actual power detected at the detected actual rotational speed is higher than a permissible amount to be expected using the predefined characteristic for the detected rotational speed.

10. The electrical household appliance according to claim 1, wherein said motor is a synchronous motor and that said monitoring device is configured to detect a rotational speed of said motor from a time behavior of an electromotive force in the windings of the motor.

11. The electrical household appliance according to claim 1, wherein said motor has an armature disposed in a pump chamber of said pump.

12. The electrical household appliance according to claim 1, which comprises a sensor for detecting an intensity and/or a voltage of a supply current to said motor connected to said monitoring device.

13. The electrical household appliance according to claim 1, which comprises an inverter connected for supplying the power to said motor, and wherein said inverter together with at least one of said monitoring device and said control device are combined in a component unit.

14. The electrical household appliance according to claim 1 configured as a dishwasher.

15. An electrical household appliance, comprising:

a chamber to be at least partially filled with liquid during operation of the appliance;

a pump driven by a motor and connected for drawing out liquid from said chamber;

a directional valve connected to said pump;

a monitoring device configured for detecting an actual rotational speed of said motor delivered by a rotational speed measuring circuit and an actual power of said motor; and a read only memory connected to said monitoring device, said read only memory storing a plurality of predetermined rotational speed-power characteristics each describing a relationship between rotational speed and input electrical power, said monitoring device configured for respectively selecting one of the predetermined rotational speed-power characteristics allocated to a current position of said directional valve, said monitoring device configured for reading a theoretical power value from said read only memory corresponding to the actual speed according to the characteristic selected, said monitoring device configured for comparing the theoretical power value with the actual power and generating a fault indication if the actual power differs from the theoretical power by more than a permissible amount.

16. An electrical household appliance, comprising:

a chamber to be at least partially filled with liquid during operation of the appliance;

a pump driven by a motor and connected for drawing out liquid from said chamber;

a monitoring device configured to detect both an actual rotational speed and an actual power of said motor; and a read only memory connected to said monitoring device, said read only memory storing a plurality of predefined rotational speed-power characteristics each describing a relationship between rotational speed and power, said monitoring device configured for respectively selecting one of the predefined rotational speed-power characteristics allocated to a current working sequence of the household appliance, said monitoring device configured for reading an expected power value from said read only memory corresponding to the detected actual speed according to the predefined characteristic selected, said monitoring device configured for comparing the expected power value with the detected actual power and generating a fault indication if the detected actual power differs from the expected power by more than a permissible amount.

* * * * *

UNITED STATES PATENT AND TRADEMARK OFFICE

CERTIFICATE OF CORRECTION

PATENT NO. : 8,439,052 B2
APPLICATION NO. : 10/587192
DATED : May 14, 2013
INVENTOR(S) : Hans-Wilhelm Klein It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1272 days.

Signed and Sealed this
Eighth Day of September, 2015

Michelle K. Lee

Michelle K. Lee
*Director of the United States Patent and Trademark Office*